US005313143A

United States Patent [19]

Vila-Masot et al.

[11] Patent Number: 5,313,143

[45] Date of Patent: May 17, 1994

[54] MASTER-SLAVE HALF-BRIDGE DC-TO-AC SWITCHMODE POWER CONVERTER

[75] Inventors: Oscar Vila-Masot, Puerto La Cruz, Venezuela; Janos Melis, Miami, Fla.

[73] Assignee: LED Corporation N.V., St. Maarten, Netherlands Antilles

[21] Appl. No.: 852,512

[22] Filed: Mar. 17, 1992

Related U.S. Application Data

[63] Continuation-in-part of Ser. No. 720,676, Jun. 25, 1991, Pat. No. 5,097,183.

[51] Int. Cl.[5] ..... H05B 37/02

[52] U.S. Cl. ..... 315/209 R; 315/DIG. 7; 315/DIG. 4; 315/291; 315/307; 315/294; 315/324; 315/226; 331/113 A; 363/72; 363/132

[58] Field of Search ..... 315/226, 209 R, DIG. 7, 315/DIG. 4, 290, 291, 367, 294, 324; 331/113 A; 363/72, 132

[56] References Cited

U.S. PATENT DOCUMENTS 5,097,183 3/1992 Vila-Masot et al. ..... 315/226

*Primary Examiner*—Robert J. Pascal
*Assistant Examiner*—Michael B. Shingleton
*Attorney, Agent, or Firm*—Hoffman, Wasson & Gitler

[57] ABSTRACT

The invention pertains to a switchmode DC to AC converter, and particularly to a master-slave half-bridge converter. The slave half-bridge power converter is controlled by a lower power self-oscillating half-bridge master converter. More particularly, the invention pertains to a high frequency ballast for gas discharge devices, especially, for high pressure sodium lamps, completed by a high voltage ignition apparatus. A pair of self-saturated electronically switched transformers controlled by a low power current source provide a power controlled and frequency modulated high frequency ballast for the gas discharge devices.

8 Claims, 8 Drawing Sheets

MASTER-SLAVE HALF-BRIDGE DC-TO-AC SWITCHMODE POWER CONVERTER

This application is a continuation-in-part application of Ser. No. 07/720,676, filed Jun. 25, 1991, now U.S. Pat. No. 5,097,183.

BACKGROUND OF THE INVENTION

1. Field of the Invention

The present invention relates to high frequency DC to AC switchmode power converters and specifically to high frequency ballasts for gas discharge devices. More specifically, the present invention relates to a high frequency ballast for high pressure sodium lamps.

2. Prior Art

Self-oscillating DC-to-AC converters have a significant position in the field of switchmode power converters, due to their simplicity and usefulness. Generally, DC-to-AC converters are configured as push-pull, half-bridge or full-bridge. One of the simplest, and oldest, DC-to-AC self-oscillating push-pull converters is the Royer circuit. Another topology similar to the Royer circuit, which removes the switch drive function from the main power transformer, is the self-oscillating voltage or current driven Jensen circuit. The common disadvantage of the push-pull configurations is the imbalance problem of the push-pull transformer, especially when applied to asymmetrical loads.

An important application of the simple self-oscillating DC-to-AC switchmode power converters is supplying gas discharge devices, especially high pressure sodium (HPS) lamps in the range of 35 to 400 watts. In this case, the load impedance of the DC-to-AC converter is a HPS lamp connected in series with an inductor. In the case of a high frequency powering of the HPS lamp, the interaction between the high frequency ballast and the lamp is stronger than that of a conventional ballast. This high frequency ballast is significantly better than a conventional ballast due to its lessened weight and higher efficiency. Additionally, the high frequency ballast, utilized with an HPS lamp would have a longer life time, exhibit better light efficiency (lumen per watt) and display a better color temperature.

Therefore, the critical design targets for high frequency ballasts supplying HPS lamps would be the following:

(a) very high efficiency (energy saving);

(b) ensuring that the lamp power is maintained between an allowed maximum and minimum power during the lifetime of the lamp at ±20% input voltage fluctuation;

(c) protection against the imbalance effect caused by the asymmetrical loading feature of the ignited HPS lamp;

(d) providing high voltage (3000V–4000V) ignition pulses;

(e) the relative simplicity of the ballast which would result in a lower cost;

(f) reliability and longer life time; and (g) eliminating the possibility of acoustic resonance by using frequency modulation.

The prior art is replete with many known push-pull configurations providing high frequency ballast for gas discharge lamps. A typical Jensen push-pull which can be used with HPS lamps is U.S. Pat. No. 4,935,673 entitled "Variable impedance electronic ballast for gas discharge device", assigned to the assignee of the present invention, including an improved current driven Jensen push-pull converter.

SUMMARY OF THE INVENTION

It is an object of the present invention to provide a master-slave half-bridge DC-to-AC switchmode power converter which has a substantially improved efficiency and it is protected against the effect of an asymmetrical load.

A second object of the present invention is to provide a self-oscillating half-bridge switchmode converter which has an improved efficiency and in which the frequency depends linearly on the DC input voltage.

A further object of the present invention is to provide a magnetically coupled MOSFET driver which has a substantially improved current sink capability, and therefore very short switching which is especially significant when the load is inductive.

A further object of the present invention is to provide a high frequency ballast for gas discharge devices having substantially improved efficiency, stability and reliability.

Another object of the present invention is to provide a high frequency ballast for HPS lamps which has a high voltage ignition circuit, providing imbalance protection against the effect of the asymmetrical feature of the ignited HPS lamp.

Yet another object of the present invention is to provide a power controlled and frequency modulated high frequency ballast for gas discharge devices, wherein ignition is provided by a symmetrical, high frequency (greater than 100 kHz) sinusoidal voltage waveform.

These and other objects, features and advantages of the present invention will be more readily apparent from the following detailed description, wherein reference is made to the drawings.

DETAILED DESCRIPTION OF THE INVENTION

Figure 1B:
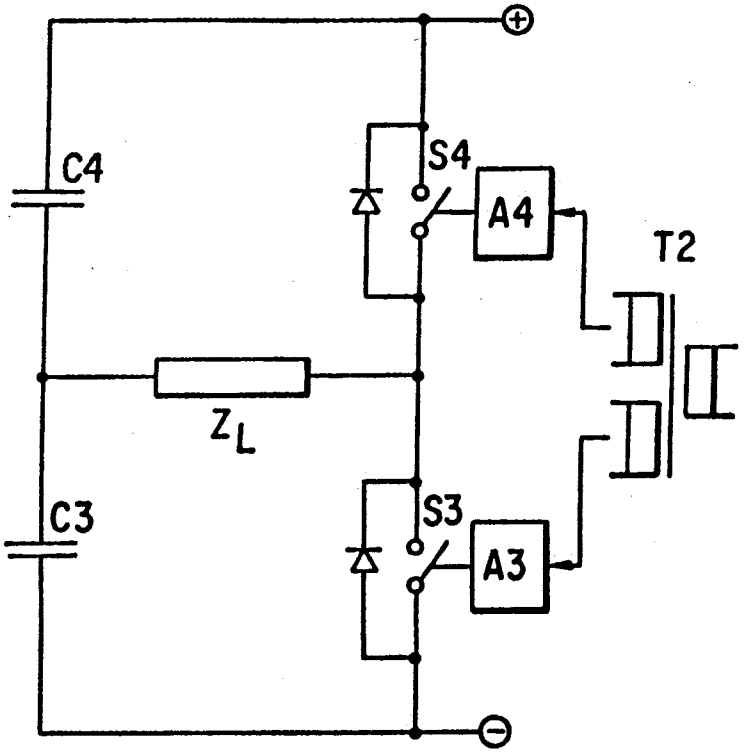
FIGS. 1A, 1B, 1C and 1D illustrate the evolution of the preferred master-slave half-bridge DC-to-AC switchmode power converter.
Figure 1A:
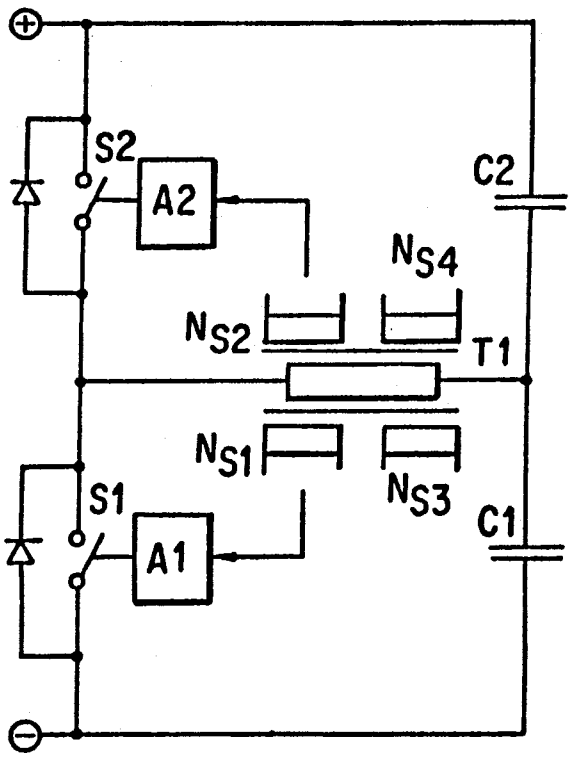

FIG. 1A shows a simplified diagram of a self-oscillating half-bridge DC-to-AC switchmode converter used as a low power master controller connected to a DC power supply. The master controller half-bridge configuration includes two electronically controlled switches S1 and S2 noted as master switches, a non-saturated control transformer T1 provided with four secondary windings used as a master control transformer, and voltage divider capacitors C1 and C2. Two secondary feedback windings $N_{S1}$ and $N_{S2}$ of the transformer T1, provide control signals to two driver apparatuses A1 and A2 controlling the master switches S1 and S2, respectively. The remaining two secondary windings $N_{S3}$ and $N_{S4}$ of the transformer T1, provide square wave AC signals for any other control purposes. The primary winding of the transformer T1 is connected between the two switches S1, S2 and the two capacitors C1, C2.

FIG. 1B illustrates the half-bridge DC-to-AC switchmode converter as a controlled slave power converter connected to a DC power supply. The controlled slave power converter includes two electronically controlled switches S3 and S4 acting as slave switches, a non-saturated control transformer T2 having a primary winding and two secondary windings providing control signals to the driver apparatuses A3 and A4 of the slave switches S3 and S4 respectively. Furthermore, two voltage divider capacitors C3, C4 and a load impedance $Z_L$ connected between the two capacitors C3, C4 and the slave switches S3, S4 is also included.

Figure 1C:
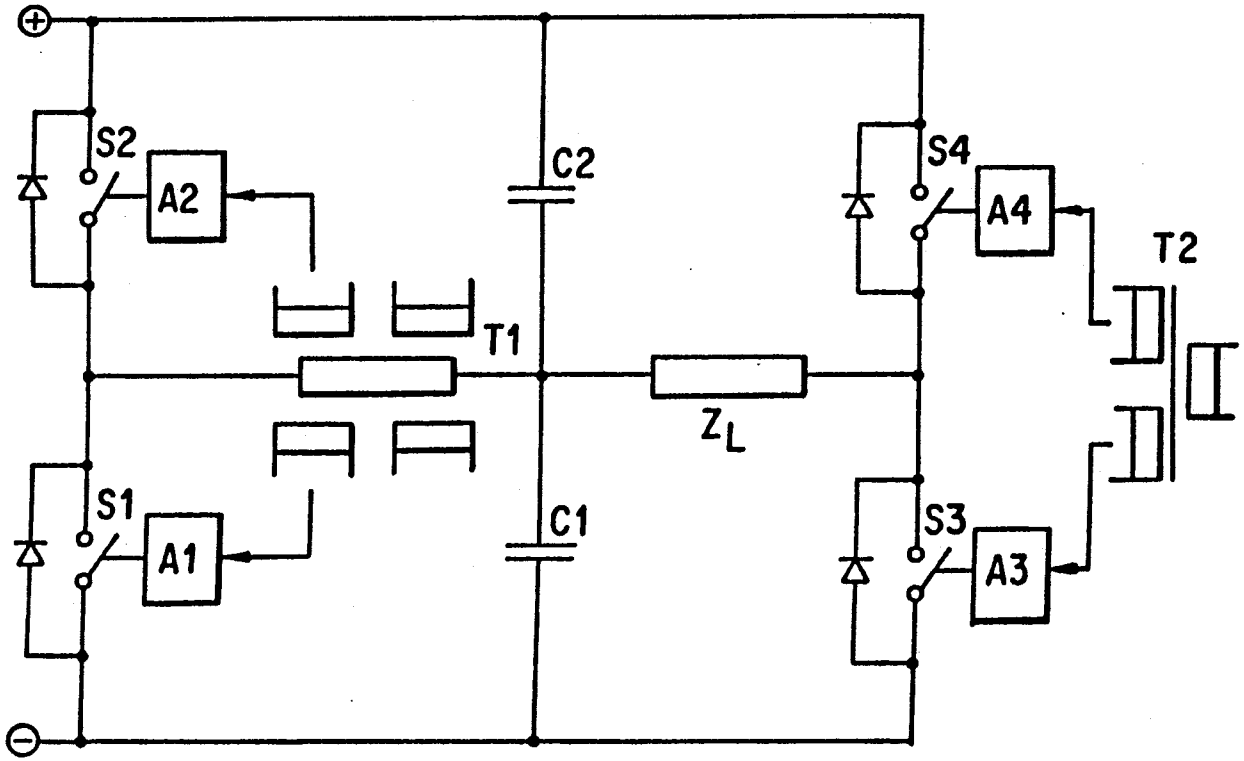

FIG. 1C shows a topological connection between the previously described master and slave half-bridge configurations in which a single DC power supply is shown. Furthermore, only a single set of voltage divider capacitors C1 and C2 are included.

Figure 1D:
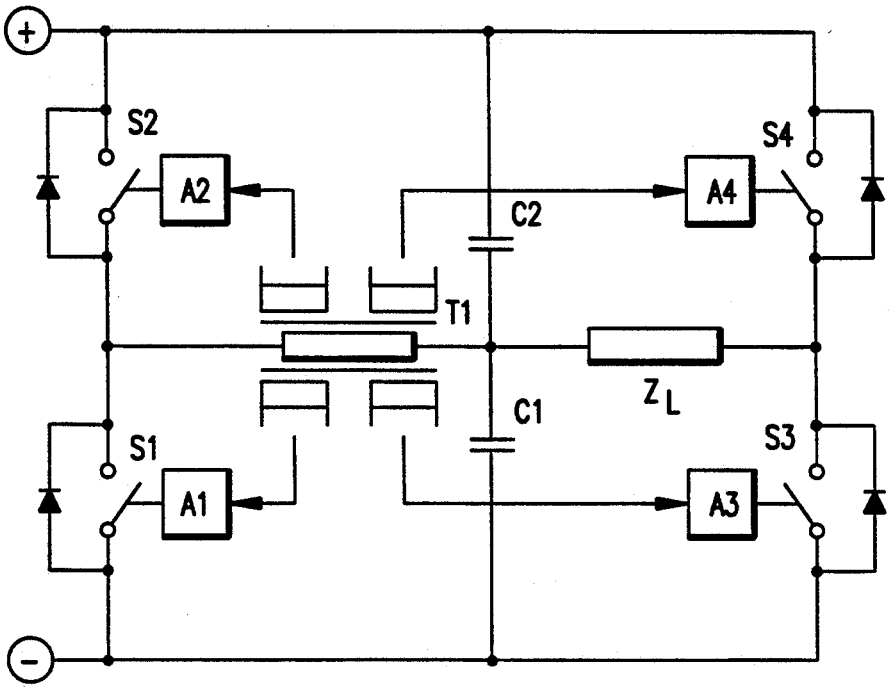

FIG. 1D illustrates the control connection between the topologically connected master and slave half-bridge configurations, in which a single control transformer T1, having a single primary winding and four secondary windings, is included. Two of the secondary windings are connected to driver apparatuses A1 and A2 and the remaining two secondary windings are connected to driver apparatuses A3 and A4.

Figure 1E:
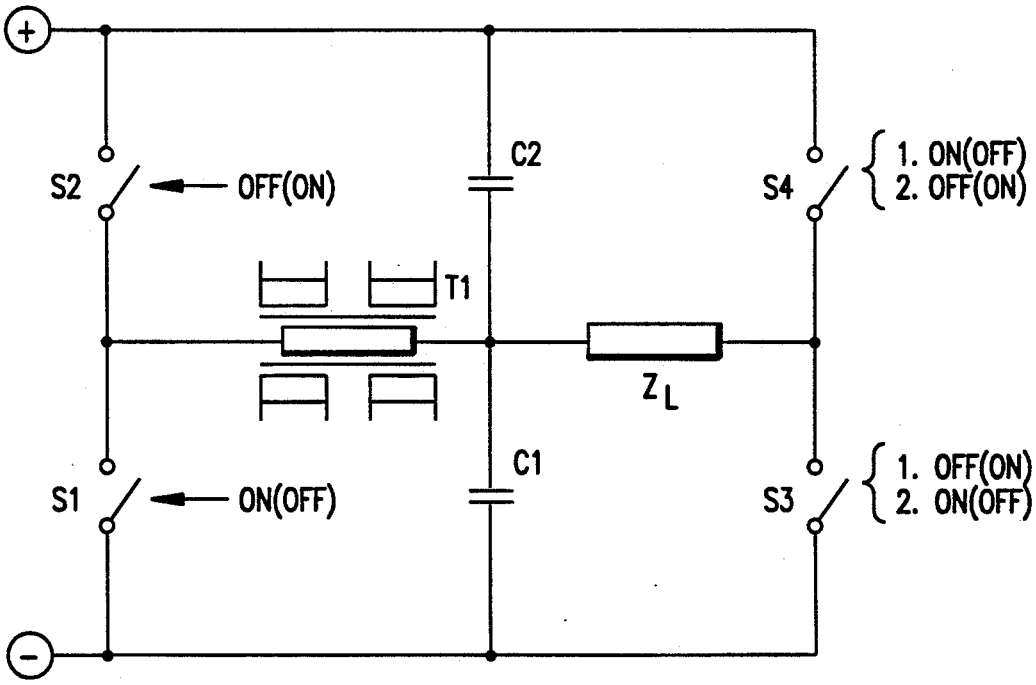
FIG. 1E illustrates the two possible phase connections between the master and slave converters.

FIG. 1E shows the two possible phase connections between the master and slave half-bridge configuration as a first phase connection (1) and a second phase connection (2).

Utilizing the following equation:

$$U_1 \cdot t_1 = U_2 \cdot t_2 \quad (1)$$

where $t_1$ and $t_2$ are the ON times of the master switches S1 and S2 respectively, $U_1$ and $U_2$ are the voltages of the identified voltage divider capacitors and $U_1+U_2$ =input DC voltage. The phase connections in FIG. 1E can be analyzed.

Assuming the first phase connection in which switches S1 and S4 are ON and switches S2 and S3 are OFF, the result is a negative feedback decreasing the effect of all asymmetry which can appear in the slave power converter, such as the effect of the polarity dependent load as in the case of an HPS lamp.

Figure 2:
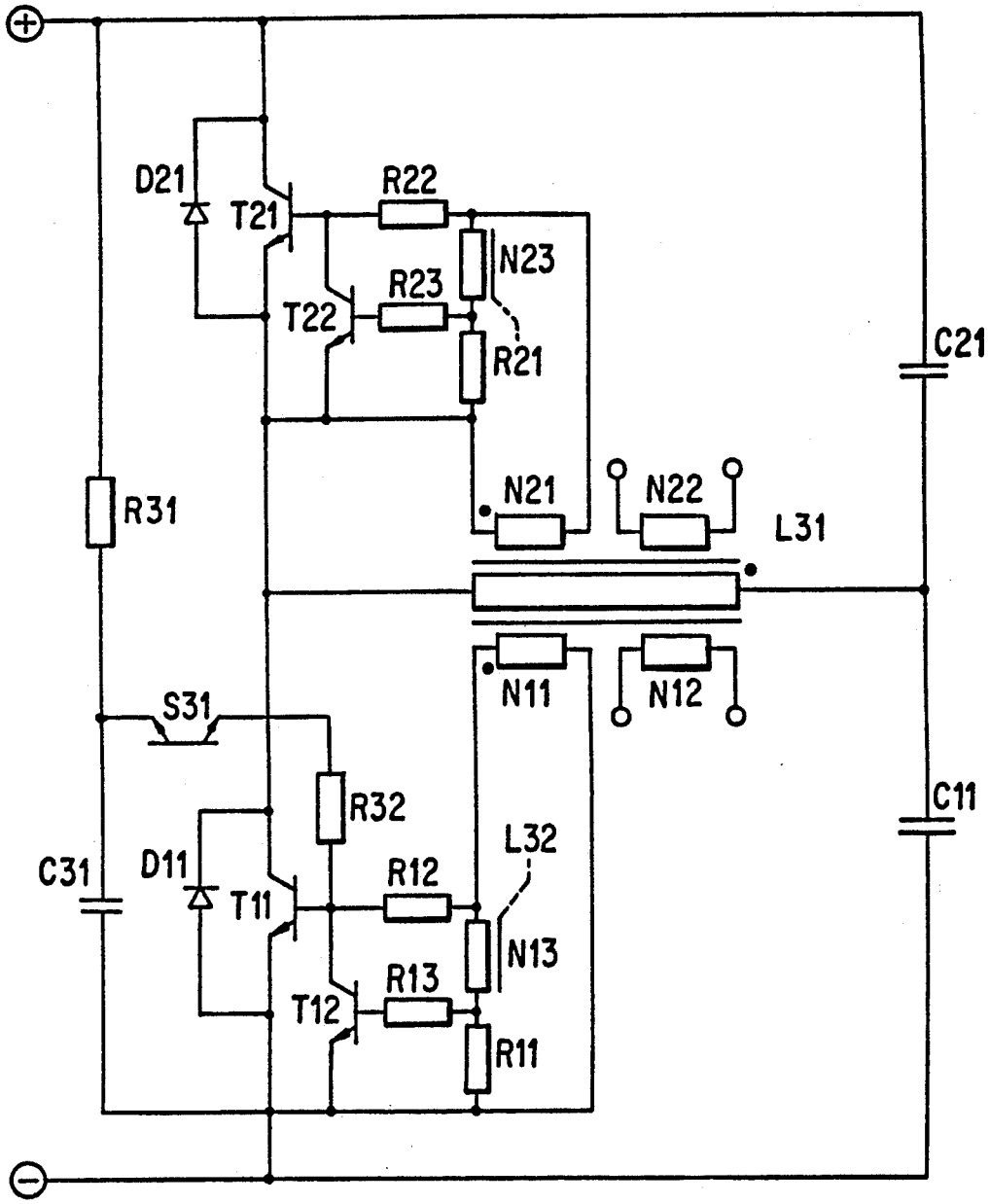
FIG. 2 shows a preferred embodiment of an improved self-oscillating half-bridge DC-to-AC switchmode converter as the master controller.

FIG. 2 shows the preferred embodiment of a self-oscillating half-bridge DC-to-AC switchmode converter including the voltage divider capacitors C11 and C21, a control transformer L31 provided with a main winding N31 and four secondary windings N11, N12, N21 and N22. Main switching transistors T11 and T21 with two clamping rectifiers D11 and D21 respectively are also provided. We can assume that T11=T21, T12=T22, D11=D21, R12=R22, R13=R23, R11=R21, N11=N21, N12=N22, N13=N23 and C11=C21.

An important part of the circuit is a saturated transformer L32 having two parallel windings N13 and N23. Assuming that the voltage of the winding N11, connected in series with resistor R12, is positive with respect to the point sign, transistor T11 must be ON. Although the magnetizing current of transformer L32 flowing in the winding N13 and series resistor R11 increases, if the voltage across the resistor R11 remains smaller than approximately 0.4V until the saturation of the transformer L32, the transistor T12 remains switched OFF. When the core of the transformer L32 is becoming saturated, the magnetizing current would quickly increase. Consequently, the voltage across the resistor R11 would also increase quickly to 0.7V, therefore opening the transistor T12 across resistor R13. Additionally, the transistor T11 would switch OFF, thereby reversing the voltage polarities in the windings of transformer L32. A similar process will be repeated in the upper part of the circuit.

Based upon equation (1), the on time $t_1$ of transistor T11 depends on the voltage of capacitor C11 because $U_{C1} \approx U_{N11}$ and $U_{N11} \cdot t_1$ is constant. Similarly, the ON time $t_2$ of transistor T22 depends on the voltage of capacitor C21 and since N13=N23 we obtain $$U_{C1} \cdot t_1 = U_{C2} \cdot t_2 \quad (2)$$

The period time $t=t_1+t_2$ and $U_{C1}+U_{C2}$ equals the input DC voltage.

If the voltages $U_{C1}$ and $U_{C2}$ are not equal, for instance if $U_{C1}>U_{C2}$, it follows that $t_1<t_2$. Conversely, if $U_{C1}<U_{C2}$ then $t_1>t_2$. This voltage dependent ON time makes the previously described self-oscillating half-bridge converter advantageous as the master controller in the master-slave half-bridge configuration.

FIG. 2 also shows a simple starter circuit including resistors R31 and R32, a capacitor C31 and a DIAC S31. The windings N22 and N12 provide square wave AC signals if the circuit is designated as a master control half-bridge square wave oscillator.

Figure 3:
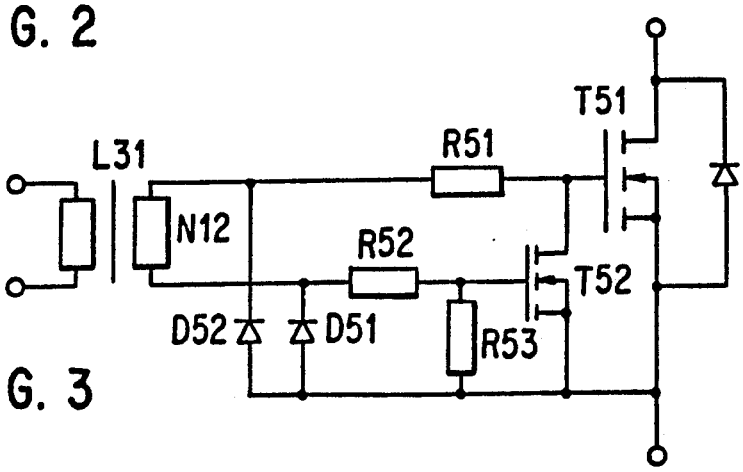
FIG. 3 shows a preferred embodiment of an improved magnetically coupled MOSFET-driver according to the present invention.

FIG. 3 shows a preferred embodiment of an improved MOSFET driver used with the present invention. The control transformer L31 provides a square wave AC control signal. During the positive half-period, with respect to the point sign of the secondary winding N12, a positive voltage is connected across the resistor R51 and rectifier D51 to the gate of an N-channel MOSFET T51 providing the ON state, while N-channel MOSFET T52 is in the OFF state. During the negative half-period, a positive voltage is connected across the resistor R52 and rectifier D52 to the gate of MOSFET T52 providing the ON state. Therefore, the gate of MOSFET T51 is short circuited to its source by MOSFET T52, providing an excellent current sink capability and a very short switching time for MOSFET T51. The DC power loss of the described MOSFET driver is low because only a lower current $I_{R51} \approx U_{D52}/R51$ flows in the resistor R51 when the MOSFET T52 is ON. Comparing the described MOSFET driver to the conventional driver consisting of the control transformer L31, and a resistor R51 (D51 is short circuited), a significant advantage is provided, particularly when the load current is inductive.

Figure 4:
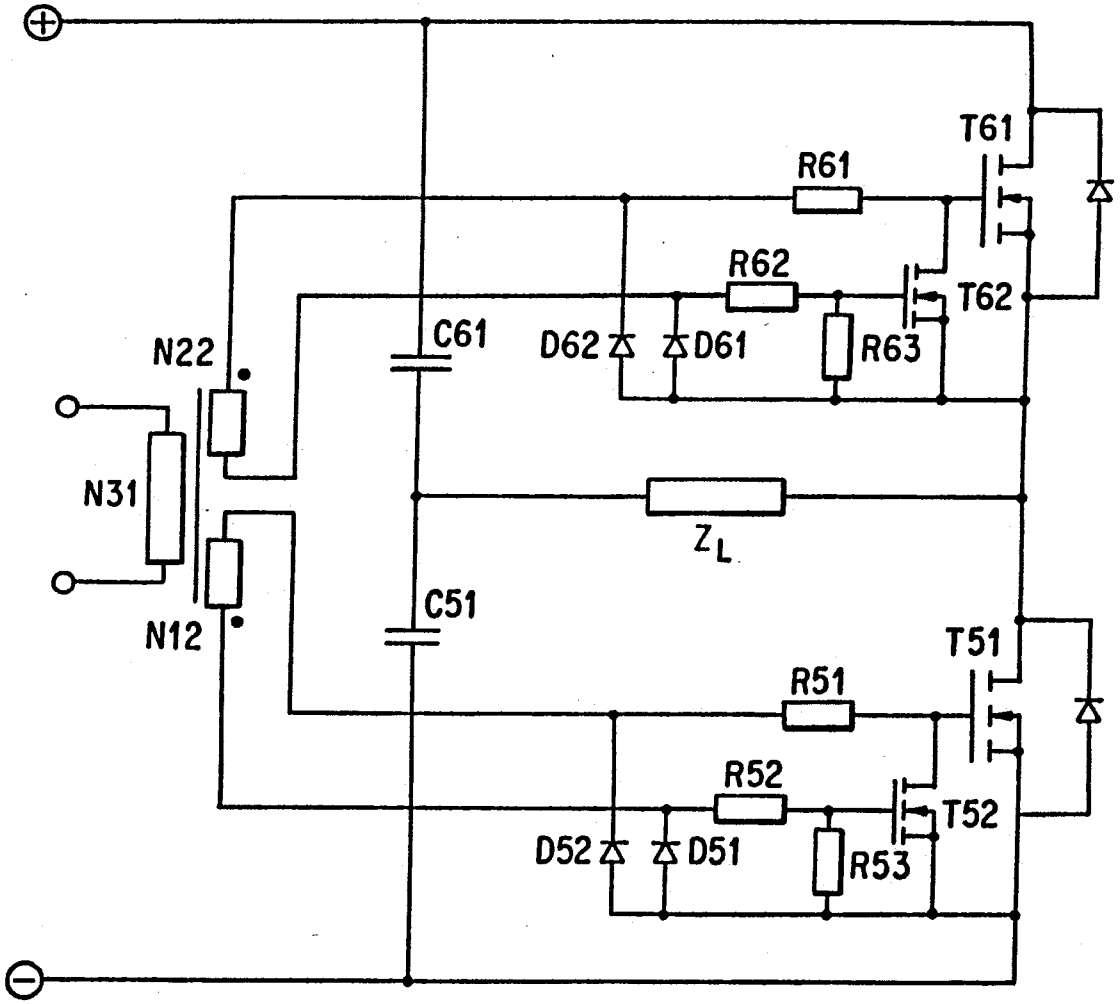
FIG. 4 shows a preferred embodiment of an improved half-bridge DC-to-AC switchmode power converter as a controlled slave.

FIG. 4 shows a preferred embodiment of an improved half-bridge DC to AC switchmode power converter as the controlled slave using two equivalent MOSFET drivers as previously described as well as the electronically controlled MOSFET switches. Capacitors C51 and C61 are the voltage divider capacitors, $Z_L$ is the load impedance and T51=T61, T52=T62, D51=D61, D52=D62, R51=R61 R52=R62, R53=R63 and C51=C61.

Figure 5:
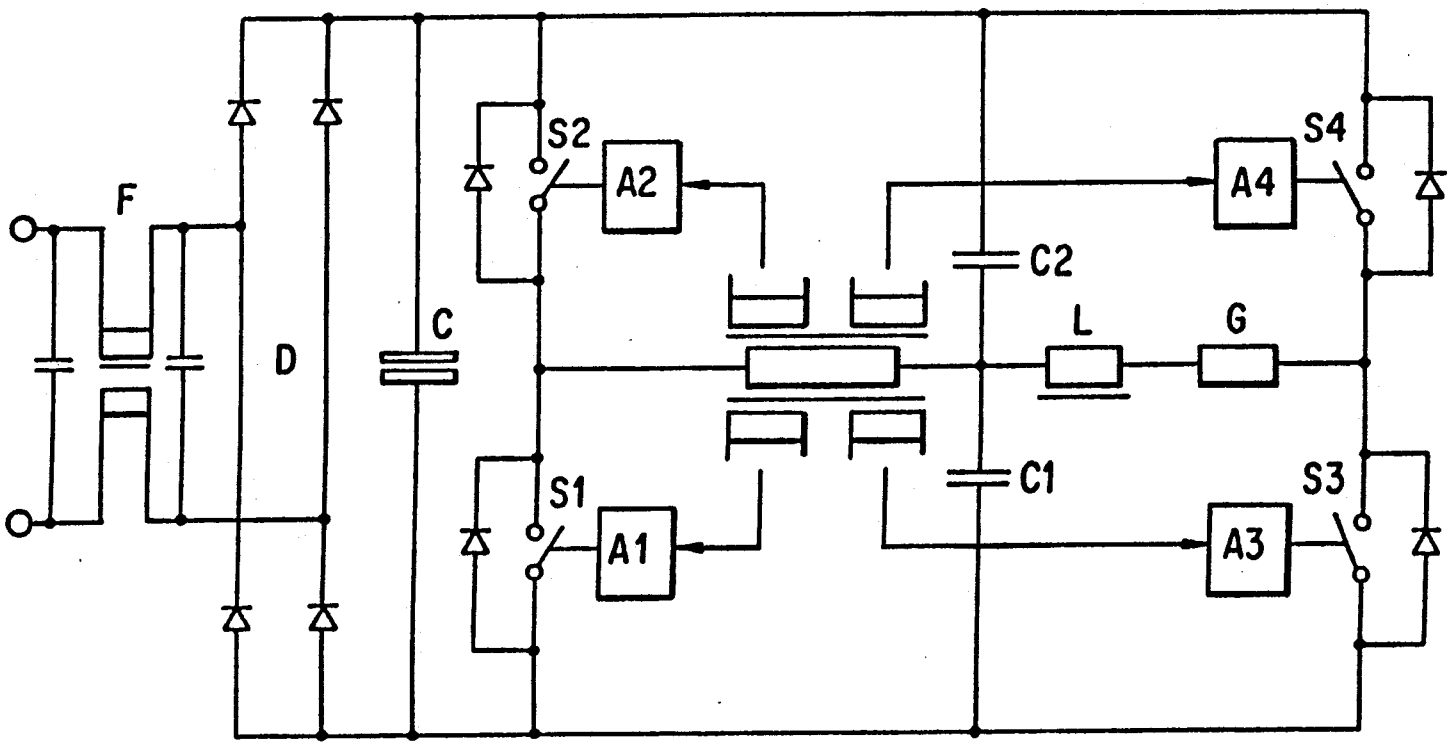
FIG. 5 illustrates a schematic diagram of the preferred high frequency ballast gas discharge device.

FIG. 5 illustrates a schematic diagram of the preferred high frequency ballast for gas discharge devices. The high frequency ballast includes a previously described master-slave half-bridge configuration in which the load impedance is a gas discharge device G connected in series with an inductor L. It also includes a full-wave bridge rectifier D coupled to an AC source, shunted by a charge storage capacitor C and a filter apparatus F.

Figure 6:
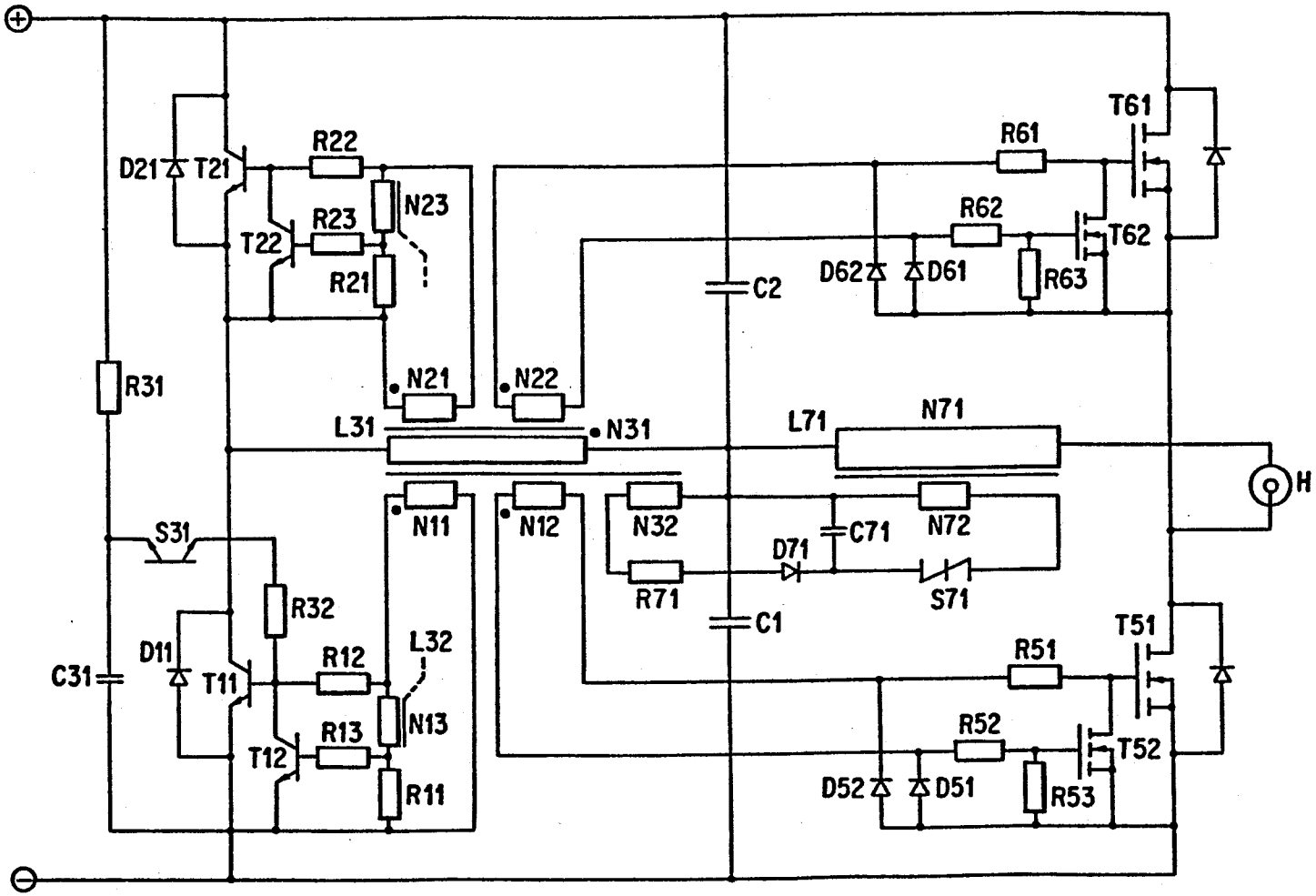
FIG. 6 shows a preferred embodiment of the high frequency ballast for HPS lamps combined with a high voltage ignition apparatus.

FIG. 6 shows a preferred embodiment of a high frequency ballast for an HPS lamp H. The high frequency ballast for the lamp H includes the previously described master-slave half-bridge DC to AC switchmode power converter in which the load impedance is the HPS lamp H connected in series with an inductor L71 including windings N71 and N72. The circuit is also provided with a high voltage ignition apparatus, in which winding N71 is connected in series with the HPS lamp H and the winding N72 is connected across a SIDAC S71 to a capacitor C71. The master control transformer L31 has a sixth winding N32 connected across a resistor R71 and a rectifier D71 to the capacitor C71, providing a charging current of capacitor C71. When the voltage of capacitor C71 reaches the switching voltage of SIDAC S71, the voltage of the capacitor C71 will reach the winding N72 and a high voltage impulse of between 3000V and 4000V will be induced in the winding N71 which is required to initiate an arc. The capacitor C71 will be discharged very quickly and the SIDAC S71 will switch off providing a new charging period of the capacitor C71.

Figure 7:
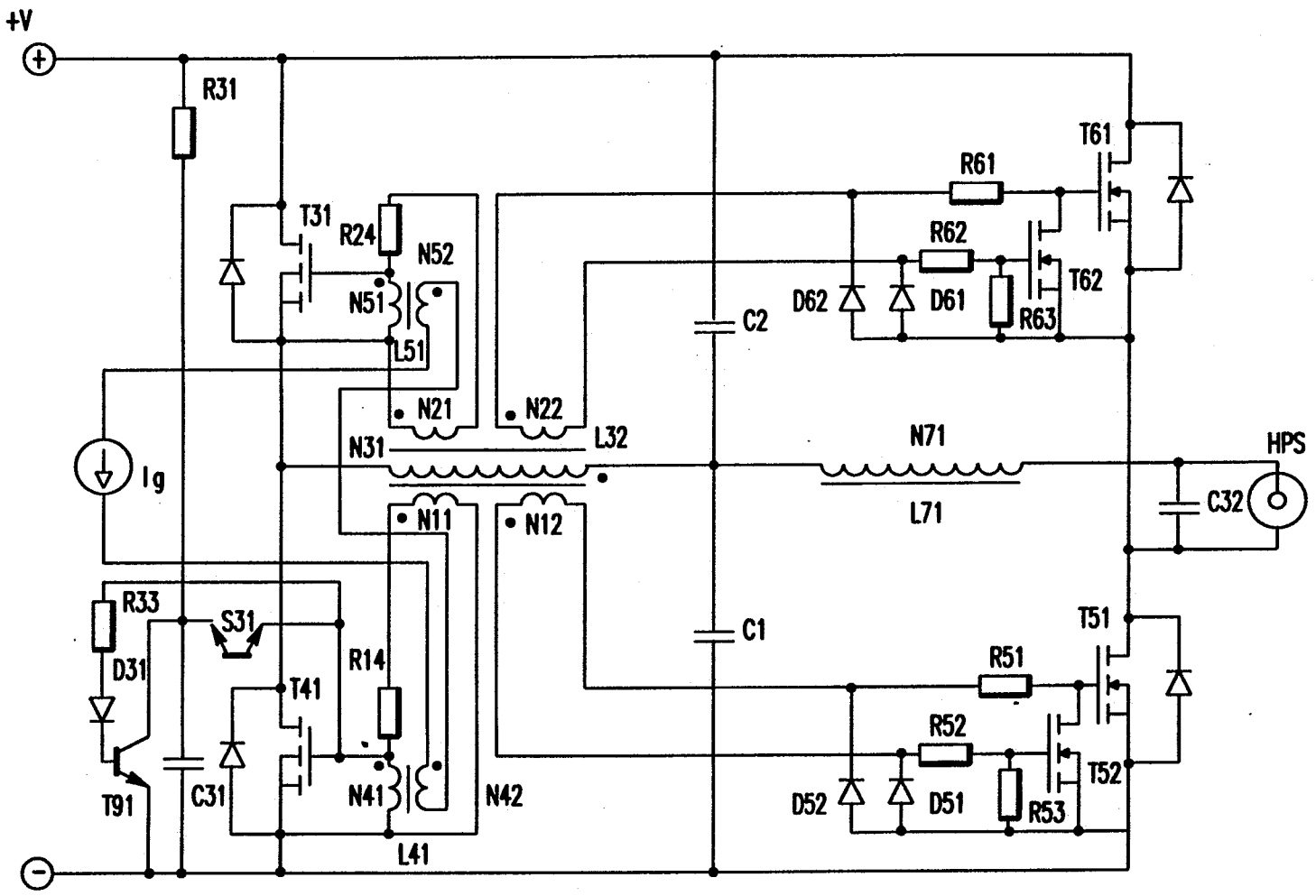
FIG. 7 illustrates a second embodiment of the present invention in which the frequency is controlled and the ignition is provided by a high frequency sinusoidal voltage waveform.

FIG. 7 illustrates a second embodiment of the master-slave half-bridge DC-to-AC switchmode power converter. This particular embodiment includes a frequency controlled master half-bridge configuration wherein the main switches T31 and T41 are MOSFETs. MOSFET T31 is connected across winding N51 of self-saturated transformer L51, and MOSFET T41 is connected across winding N41 of self-saturated transformer L41. The original self-saturated transformer L32 provided with primary winding N31 is doubled. Therefore, the two self-saturated transformers L41 and L51 can be connected by winding N42 and N52 in such a way that the frequency can be controlled by a low power current source $I_g$ providing an equal, but changeable biasing magnetizing force in the cores of these self-saturated transformers. The windings N41 and N42 are connected in series with resistors R14 and R24. Resistor R24 is connected in series with winding N21 and resistor R14 is connected in series to winding N11. Furthermore, beside the frequency control, the frequency can be changed periodically, implementing frequency modulation. Therefore, the master-slave half-bridge converter shown in FIG. 7 provides a power controlled (since the power depends on frequency) and frequency modulated high frequency ballast for gas discharge devices. In this embodiment, the inductor L71 and capacitor C32 form a series resonant LC circuit providing a sufficiently high voltage and high frequency (higher than 100 kHz) sinusoidal ignition voltage signal for gas discharge devices, especially for HPS lamps. Furthermore, FIG. 7 also illustrates a self-switching off starter unit including Diac S31, capacitor C31 transistor T91, diode D31 and resistor R33.

Thus, while preferred embodiments of the present invention have been shown and described in detail, it is to be understood that such adaptations and modifications as may occur to those skilled in the art may be employed without departing from the spirit and scope of the invention, as set forth in the claims.

What is claimed is:

1. A master-slave half-bridge DC-to-AC switchmode power converter comprising:

a DC power supply;

a self-oscillating half-bridge switchmode converter acting as a low power master converter connected to said DC power supply, said master converter provided with a master control transformer having at least five windings, two controlled master switches, first and second self-saturated transformers, each of said self-saturated transformers connected between said master control transformer and each of said master switches; and a half bridge switchmode converter acting as a controlled slave power converter connected to said DC power supply and said low power master converter, said slave power converter provided with two slave switches, first and second electronic control means for controlling said slave switches, each of said electronic control means connected between said control transformer and each of said slave switches, said slave power converter further including a load impedance;

a pair of voltage divider capacitors common to said master converter and said slave converter; and a low power current source connected between said first and second self-saturated transformers for providing a power controlled and frequency modulated high frequency ballast for said load impedance and for providing said first and second self-saturated transformers with an equal biasing magnetizing force;

wherein the ON and OFF states of each of said master and slave switches are controlled by said self-oscillating half-bridge switchmode converter.

2. The master-slave half-bridge DC-to-AC switchmode power converter in accordance with claim 1, wherein said first winding of said master control transformer is connected between the common point of said master switches and said voltage divider capacitors, said second and third windings of said master control transformer, are respectively connected to said first and second self-saturated transformers and said fourth and fifth windings of said master control transformer are respectively connected to said first and second electronic control means.

3. The master-slave half-bridge DC-to-AC switchmode power converter in accordance with claim 2 wherein each of said slave switches is a MOSFET and each of said first and second electronic control means is provided with an additional MOSFET connected to said slave switch MOSFET, each of said first and second electronic control means provided with first and second rectifiers respectively connected to common sources of said slave switch MOSFET and said additional MOSFET, and each of said first and second electronic control means provided with first and second resistors connected between said first and second rectifiers and said slave switch MOSFET and said additional MOSFET, and wherein said fourth and fifth windings are respectively connected to said first and second electronic control means provide a square wave AC control signal providing ON or OFF states to said slave switch MOSFET dependent upon the polarity of the square wave AC control signal.

4. The master-slave half-bridge DC-to-AC switch-mode power converter in accordance with claim 1 further including a gas discharge device connected in series with an inductor acting as said impedance.

5. The master-slave half-bridge DC-to-AC switch-mode power converter in accordance with claim 2 further including a gas discharge device connected in series with an inductor acting as said impedance.

6. The master-slave half-bridge DC-to-AC switch-mode power converter in accordance with claim 1 wherein said load impedance is a high pressure sodium lamp and an inductor, and further including an ignition device connected to said high pressure sodium lamp, said ignition device including an electronic switch providing periodic high voltage impulses in said inductor when said electronic switch is periodically ON.

7. The master-slave half-bridge DC-to-AC switch-mode power converter in accordance with claim 1, wherein said two controlled master switches are MOSFETS.

8. The master-slave half-bridge DC-to-AC switch-mode power converter in accordance with claim 1 wherein said load impedance is a high pressure sodium lamp and an inductor, and further including a capacitor connected in parallel to said high pressure sodium lamp providing a high voltage and high frequency LC resonant circuit with said inductor as an ignition apparatus for said high pressure sodium lamp.

* * * * *